United States Patent [19]

Benade

[11] 3,992,281

[45] Nov. 16, 1976

[54] REMOVAL OF SOLID CONTAMINANTS FROM TAR AND TAR-LIKE PRODUCTS

[75] Inventor: Dirk Christoffel Benade, Sasolburg, South Africa

[73] Assignee: South African Coal, Oil & Gas Corporation Limited, Sasolburg, South Africa

[22] Filed: Feb. 27, 1975

[21] Appl. No.: 553,786

[52] U.S. Cl. ..... 208/45; 208/39

[51] Int. Cl.[2] ..... C10C 1/00

[58] Field of Search ..... 208/39, 45; 196/14.52, 196/46, 46.1

[56] References Cited

UNITED STATES PATENTS 1,988,714 1/1935 Bray ..... 208/45

2,449,404 9/1948 Miller ..... 208/39

*Primary Examiner*—Herbert Levine

*Attorney, Agent, or Firm*—Young & Thompson

[57] ABSTRACT

A method of separating tar from solid contaminant including the steps of dissolving the tar in a compatible solvent; and separating dissolved tar from solid material. Preferably, contaminated tar is caused to flow in a stream; solvent is introduced into the stream of contaminated tar; the contaminated tar and the solvent are caused to flow together a predetermined distance to permit dissolution of tar; and a diluted tar fraction is separated from a solid contaminant fraction.

5 Claims, 1 Drawing Figure

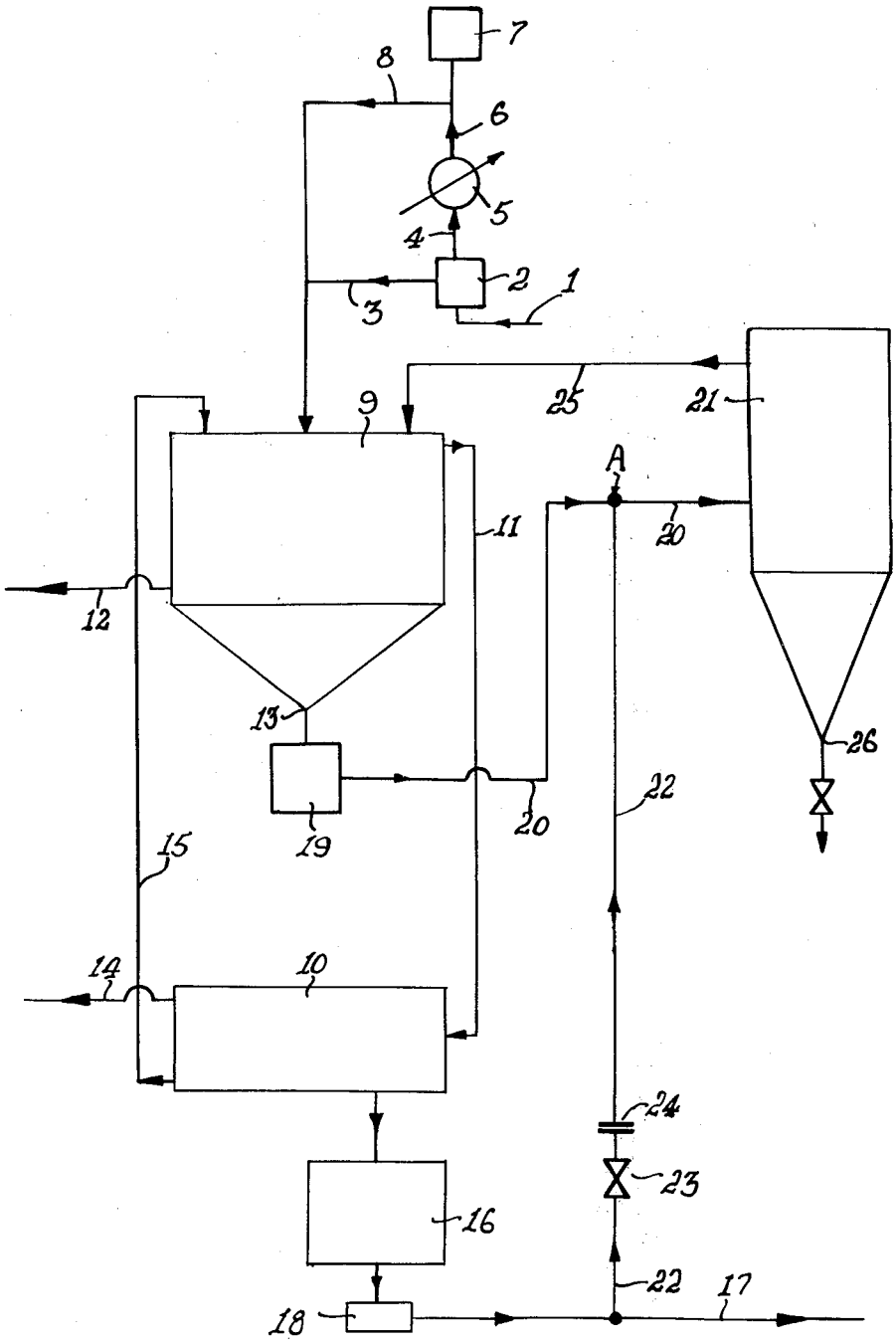
7
8
6
5
4
2
1
3
9
25
21
A
11
20
12
13
26
22
20
19
15
14
10
24
23
16
22
17
18

REMOVAL OF SOLID CONTAMINANTS FROM TAR AND TAR-LIKE PRODUCTS

This invention relates to the removal of solid contaminants from tar and tar-like products. For the purpose of this specification, the term "tar" will be used to include a tar-like product.

The tar which emanates from the gasification of coal normally contains a considerable amount of solid particles which consist mainly of coal dust and ash. It has been found that the tar may contain as much as 25% solid material. As much as possible of the solid contaminants has to be removed in order to render the tar suitable for further processing.

It is known to separate solid particles from products obtained from a gasifier in a gravity separator, but the bottom product from the separator containing separated solid particles normally includes a considerble amount of residual tar. In order to recover residual tar from the bottom product, it is known to recirculate the bottom product to the gasifier, but this method has certain distinct disadvantages. For example, the solid particles in the bottom product are highly abrasive and cause rapid wear in pumps and pipelines. Also, due to the viscid nature of the tar and solids content, pipelines are prone to blockage. Furthermore, the reintroduction of tar into a gasifier can give rise to dangerous operating conditions.

It is accordingly an object of the present invention to provide improved separation of tar from solid contaminants.

According to the invention a method of separating tar from solid contaminant includes the steps of dissolving the tar in a compatible solvent; and separating dissolved tar from solid material.

The tar may be dissolved by allowing or causing the contaminated tar and the solvent to flow together in a stream.

Preferably, contaminated tar is allowed or caused to flow in a steam; solvent is introduced into the steam of contaminated tar; the contaminated tar and the solvent are allowed or caused to flow together a predetermined distance to permit dissolution of tar; and a diluted tar fraction is separated from a solid contaminant fraction.

In a preferred application of the invention, tar obtained from a tar producing process and containing solid contaminant is subjected to a first separation treatment to separate a tar fraction from a solid contaminant fraction containing a residual amount of tar; and the contaminant fraction is subjected to treatment according to the invention as defined above to separate a diluted residual tar fraction from a solid contaminant fraction.

The solvent may be derived from the same source as the contaminated tar.

The solvent may comprise a light oil fraction formed during the same process as the contaminated tar.

Where contaminated tar from a tar producing process is subjected to a first separation treatment and the resultant solid contaminant fraction containing a residual amount of tar is subjected to treatment according to the invention as defined above, the solvent may comprise a substance separated from the contaminated tar during the first separation treatment.

According to another aspect of the invention apparatus for separating tar from solid contaminant includes separating means; a tar conduit communicating with the separating means; means operative to conduct contaminated tar along the tar conduit towards the separating means; and a solvent conduit communicating with the tar conduit ahead of the separating means in a position such that a predetermined length of the tar conduit is located between the junction of the two conduits and the separating means.

The tar conducting means may be adapted to conduct tar at a predetermined rate along the tar conduit.

The solvent conduit may be adapted to allow solvent to flow at a predetermined controlled rate therealong and into the tar conduit.

Further separating means may be located ahead of the tar conducting means, the tar conducting means being connected to a contaminant outlet from the further separating means. With this arrangement contaminated tar may be subjected to a first separation treatment in the further separating means to separate a tar fraction from a solid contaminant fraction containing a residual amount of tar. The residual tar and the solid contaminant may then be conducted along the tar conduit by the conducting means for a second separation treatment in the separating means to which the tar conduit is connected, after dissolution of residual tar in solvent in the tar conduit.

Gravity separators may be used.

A preferred embodiment of the invention will now be described by way of example with reference to the accompanying flow diagram illustrating a method according to the invention of separating solid contaminant from tar derived from a coal-gasifier.

Products obtained from the coal-gasifier (not shown) are passed along pipeline 1 to knock-out pot 2 which separates unflashed raw gas liquor from flashed vapours. The unflashed raw gas liquor is fed via pipeline 3 into primary separator 9. The flashed vapours are fed via pipeline 4 to condensor 5 from where condensed vapours flow along pipeline 6. Oil is separated from the condensed vapours in separator 7 and part of the condensed vapours are fed via pipeline 8 into primary gravity separator 9.

The products fed into primary separator 9 are separated into various fractions in accordance with their respective specific gravities. A light fraction comprising tar, liquor and oils, is extracted from the upper regions of primary separator 9 and fed to secondary separator 10 via pipeline 11. A heavier, substantially clear tar fraction is extracted from the lower regions of primary separator 9 through pipeline 12. A solid contaminant fraction containing a residual amount of tar is extracted from the bottom of primay separator 9 through oulet 13.

Gas liquor is extracted from secondary separator 10 along pipeline 14 and recovered tar is re-circulated from secondary separator 10, back to primary separator 9 along pipeline 15. A light oil fraction from secondary separator 10 collects in oil rundown tank 16 from where it can be conducted to a reservoir (not shown) along pipeline 17 by pump 18.

So far the system is conventional.

The solid contaminant fraction extracted from the bottom of primary separator 9 through outlet 13 contains a considerable amount of residual tar. According to conventional practice, the residual tar and its solid contaminant may be recovered by re-circulating it back to the gasifier or may be disposed of otherwise.

According to the present invention, however, the residual tar and its solid contaminant which is extracted from outlet 13 of primary separator 9 are conducted at a predetermined rate by metering pump 19 along tar pipeline 20 to additional gravity separator 21. Also, light oil from pipeline 17 is allowed to flow at a predetermined controlled rate along pipeline 22 into tar pipeline 20 at junction A. The light oil is capable of dissolving the viscid tar in tar pipeline 20 and is fully compatible with the tar since both the light oil and the tar are derived from the same source. The rate of flow of light oil along pipeline 22 may be controlled by valve 23 and indicated by flow indicator 24.

Residual tar and solvent oil run along the portion of tar pipeline 20 between junction A and additional separator 21 so that intimate mixng of residual tar and solvent oil occurs, thereby to cause dissolution of residual tar by the solvent oil. The length of tar pipeline 20 between junction A and additional separator 21 is selected in relation to the rates of flow of the residual tar along tar pipeline 20 and of the light oil along solvent pipeline 22, so that adequate dissolution of the residual tar is obtained.

Substantially clear dissolved tar is extracted from additional separator 21 from the upper region thereof and may be disposed of in any suitable manner, such as being re-circulated back to primary separator 9 along pipeline 25. Solid particles and a minimum amount of residual tar is extracted from the bottom of additional separator 21 through outlet 26.

NUMERICAL EXAMPLE OF INVENTION

The tar containing solid contaminants from outlet 13 of the primary separator 9 is pumped via pump 19 to the additional separator 21 at a rate of typically 40 liters per minute. The material is viscous and erosive. A typical analysis shows 20% coal dust plus ash and 15% water in the material. The viscosity of the filtered material was measured as 52 seconds in a BRTA Tar Viscometer with a 4mm cup at 35° C. The light oil, which is also a product of coal gasification and has a viscosity of 40 SSU at 35° C is pumped along pipeline 22 at a rate of 60 liters per minute. This oil still contains a small quantity of unseparated water (typically 2%).

The oil and contaminated tar flow together in pipeline 20 from junction A to the additional gravity settler 21 through a length of pipe which in this instance is 50 mm inside diameter and 6.5 meters long.

The temperature of mixed tar and light oil is not critical but should be about 60° C for efficient settling.

The overflow from the additional gravity settler 21 which is clean dissolved tar contains 1% or less solids contaminant and 3% water.

The settled solids, water and some tar are drawn off periodically from the bottom of the gravity settler 21. This material which has the consistency of wet coarse sand contains over 70% solid material, the remainder being water and some tar. This material can be handled by normal solids handling methods.

Recovery of clear tar and oil from the system is about 96 – 97%.

Applicants found that the additional separator 21 requires a very small angle cone in order to remove the solid contaminants in as dry a condition as possible. The total angle of the cone is typically 20°.

It is also found that the separators collectively can typically handle a total of about 300 $m^3$ per hour of gas liquor containing 4,000 liters per hour of tar and 2,000 liters per hour of oil.

It will be appreciated that an additional advantage of this invention is that the water is entrained with the contaminated tar may be largely settled out with the solid contaminants in the additional gravity settler.

It will be appreciated that many variations in detail are possible without departing from the scope of the appended claims.

I claim:

1. A method of recovering tar from a coal gasification process, comprising the steps of subjecting to separation a solids-contaminated tar derived from the gasification process and containing coal gas liquor and a tar solvent; separating in said separation at least one tar fraction of said derived tar from a solid contaminant fraction of said derived tar, the latter fraction containing a residual amount of tar; separating said tar solvent from the separated tar fraction; causing the solid contaminant fraction to flow in a stream; introducing the tar solvent into the flow of contaminant fraction; causing the contaminant fraction and the tar solvent to flow together a predetermined distance to permit dissolution of residual tar present in the contaminant fraction; and separating a thus-dissolved residual tar fraction from said solid contaminant fraction.

2. A method as claimed in claim 1, in which said tar solvent is a light oil fraction.

3. A method as claimed in claim 1, in which the first-mentioned separation is effected by gravity.

4. A method as claimed in claim 3, in which the last-mentioned separation is effected by gravity.

5. A method as claimed in claim 1, in which the last-mentioned separation is effected by gravity.

* * * * *